US007628340B2

(12) United States Patent
Czimmek

(10) Patent No.: US 7,628,340 B2
(45) Date of Patent: Dec. 8, 2009

(54) CONSTANT CURRENT ZERO-VOLTAGE SWITCHING INDUCTION HEATER DRIVER FOR VARIABLE SPRAY INJECTION

(75) Inventor: Perry Robert Czimmek, Williamsburg, VA (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 378 days.

(21) Appl. No.: 11/708,993

(22) Filed: Feb. 21, 2007

(65) Prior Publication Data

US 2007/0200006 A1 Aug. 30, 2007

Related U.S. Application Data

(60) Provisional application No. 60/777,084, filed on Feb. 27, 2006.

(51) Int. Cl.
*B05B 1/24* (2006.01)
*B05B 1/30* (2006.01)

(52) U.S. Cl. ..... 239/135; 239/584; 239/585.1

(58) Field of Classification Search ..... 239/135, 239/128, 133, 102.2, 533.2, 585.1–585.5, 239/584; 73/114.42, 114.43, 114.45
See application file for complete search history.

(56) References Cited

U.S. PATENT DOCUMENTS 4,533,316 A 8/1985 Takino et al.
5,201,341 A * 4/1993 Saito et al. ..... 137/341
5,948,978 A * 9/1999 Feller ..... 73/204.15
6,102,303 A 8/2000 Bright et al.
6,176,226 B1 1/2001 Nines et al.
6,276,347 B1 8/2001 Hunt
6,664,769 B1 * 12/2003 Haas ..... 323/207
6,681,769 B2 1/2004 Sprinkel, Jr. et al.
6,688,533 B2 2/2004 Nines et al.

FOREIGN PATENT DOCUMENTS

DE 3029283 A1 4/1982
DE 10045753 A1 3/2002
DE 10057630 A1 5/2002

* cited by examiner

*Primary Examiner*—Davis Hwu

(57) ABSTRACT

An electronic high frequency induction heater driver, for a variable spray fuel injection system, uses a zero-voltage switching oscillator that is impedance coupled to an imbedded multiple function signal separator and integrated with a conventionally implemented electronic fuel injector driver. The induction heater driver, upon receipt of a turn-on signal, multiplies a supply voltage through a self-oscillating series resonance, and couples the high frequency energy to a high pass filter such that the useful energy is utilized in an appropriate loss component so that fuel inside a fuel component is heated to a desired temperature.

8 Claims, 8 Drawing Sheets

CONSTANT CURRENT ZERO-VOLTAGE SWITCHING INDUCTION HEATER DRIVER FOR VARIABLE SPRAY INJECTION

CROSS REFERENCE TO RELATED APPLICATIONS

This application claims the benefit of priority from U.S. Provisional Patent Application Ser. No. 60/777,084 entitled "Constant Current Zero-Voltage Switching Induction Heater Driver for Variable Spray Injection," filed on Feb. 27, 2006, the contents of which are hereby incorporated by reference herein in their entirety.

FIELD OF THE INVENTION

The present invention relates generally to heated tip fuel injectors, and more particularly, to a method and apparatus for controlling and driving an induction-heated fuel injector.

BACKGROUND OF THE INVENTION

There is a continued need for improving the emissions quality of internal combustion engines. At the same time, there is pressure to minimize engine crank times and time from key-on to drive-away, while maintaining maximum fuel economy. Those pressures apply to engines fueled with alternative fuels such as ethanol as well as to those fueled with gasoline.

During cold temperature engine start, the conventional spark ignition internal combustion engine is characterized by high hydrocarbon emissions and poor fuel ignition and combustibility. Unless the engine is already at a high temperature after stop and hot-soak, the crank time may be excessive, or the engine may not start at all. At higher speeds and loads, the operating temperature increases and fuel atomization and mixing improve.

During an actual engine cold start, the enrichment necessary to accomplish the start leaves an off-stoichiometric fueling that materializes as high tail-pipe hydrocarbon emissions. The worst emissions are during the first few minutes of engine operation, after which the catalyst and engine approach operating temperature. Regarding ethanol fueled vehicles, as the ethanol percentage fraction of the fuel increases to 100%, the ability to cold start becomes increasingly diminished, leading some manufacturers to include a dual fuel system in which engine start is fueled with conventional gasoline and engine running is fueled with the ethanol grade. Such systems are expensive and redundant.

Another solution to cold start emissions and starting difficulty at low temperature is to pre-heat the fuel to a temperature where the fuel vaporizes quickly, or vaporizes immediately ("flash boils"), when released to manifold or atmospheric pressure. Pre-heating the fuel replicates a hot engine as far as fuel state is considered.

A number of pre-heating methods have been proposed, most of which involve preheating in a fuel injector. Fuel injectors are widely used for metering fuel into the intake manifold or cylinders of automotive engines. Fuel injectors typically comprise a housing containing a volume of pressurized fuel, a fuel inlet portion, a nozzle portion containing a needle valve, and an electromechanical actuator such as an electromagnetic solenoid, a piezoelectric actuator or another mechanism for actuating the needle valve. When the needle valve is actuated, the pressurized fuel sprays out through an orifice in the valve seat and into the engine.

One technique that has been used in preheating fuel is to provide a positive temperature coefficient ceramic heater designed into a fuel injector to heat the fuel surrounding the heater. An exemplary fuel injector having a ceramic heater is disclosed in U.S. Pat. No. 6,102,303. Another technique is the use of a resistively heated capillary tube within which fuel is passed to heat the fuel to vapor. An exemplary aerosol generator including a heated capillary tube is disclosed in U.S. Pat. No. 6,681,769. Both those solutions require electrical connections penetrating through the injector wall into the fuel passage, leading to an increased risk of fuel leakage. Those techniques further require separate conductors for providing power to the injector heater, complicating wiring harnesses and connectors.

Another method for pre-heating fuel is to inductively couple energy into the injector with a time-varying magnetic field. That can be done while maintaining a hermetically sealed fuel passage, as no electrical penetration is necessary. The energy is converted to heat inside a component suitable in geometry and material to be heated by the hysteretic and eddy-current losses that are induced by the time-varying magnetic field.

The inductive fuel heater is useful not only in solving the above-described problems associated with gasoline systems, but is also in pre-heating ethanol grade fuels to accomplish successful starting without a redundant gasoline fuel system.

Because the induction heating technique uses a time-varying magnetic field, the system must include electronics for providing an appropriate high frequency alternating current to an induction coil in the fuel injector.

Conventional induction heating is accomplished with hard-switching of power, or switching when both voltage and current are non-zero in the switching device. Typically, switching is done at a frequency near the natural resonant frequency of a resonator, or tank circuit. The resonator includes an inductor and capacitor that are selected and optimized to resonate at a frequency suitable to maximize energy coupling into the heated component.

The natural resonant frequency of a tank circuit is $fr=1/(2\pi\sqrt{LC})$, where L is the circuit inductance and C is the circuit capacitance. The peak voltage at resonance is limited by the energy losses of the inductor and capacitor, or decreased quality factor, Q, of the circuit. Hard-switching can be accomplished with what are called half-bridge or full-bridge circuits, comprising of a pair or two pairs of semiconductor switches, respectively. The switches may be any number of semiconductor types, such as a thyristor, triac, PNP or NPN transistor, Darlington transistor, FET (Field Effect Transistor), MOSFET (Metal Oxide Semiconductor FET), IGBT (Insulated Gate Bipolar Transistor), or vacuum and gas tube types, such as krytron, thyratron, ignitron, tetrodes, etc. Hard-switching of power results in the negative consequences of switching noise, and high amplitude current pulses at resonant frequency from the voltage supply, or harmonics thereof. Also, hard switching dissipates power during the linear turn-on and turn-off period when the switching device is neither fully conducting nor fully insulating. The higher the frequency of a hard-switched circuit, the greater the switching losses.

In an engine environment, fuel injectors are coupled to the electronic controllers through a system of wiring harnesses and connectors. Heated fuel injectors have required additional conductors for driving the heating elements in the injectors, Those additional conductors have complicated the connectors and harnesses, and have increased expense and potential failure points in the wiring system.

There is therefore presently a need to provide a fuel injector heater circuit and method of driving a heated fuel injector wherein switching is done at the lowest possible interrupted power. There is furthermore a need to reduce the number of conductors used for each fuel injector. To the inventor's knowledge, no such controller or method is currently available.

SUMMARY OF THE INVENTION

One embodiment of the present invention is an electronic high frequency induction heater driver. The heater driver includes a tank circuit having first and second nodes, a tank inductor and a tank capacitor, the tank inductor and tank capacitor being connected in parallel between the first and second nodes, the tank inductor and tank capacitor having values defining a natural frequency at which a voltage between the nodes oscillates between negative and positive values. The heater driver further includes a loss replenishment current source connected to a center tap of the tank inductor, and includes first and second oscillator switches. The first oscillator switch has an open state whereby the first node is isolated from ground and a closed state whereby the first node is grounded. The first oscillator switch is configured to change states substantially when the voltage between the nodes crosses zero. The second oscillator switch has an open state whereby the second node is isolated from ground and a closed state whereby the second node is grounded. The second oscillator switch is configured to change states substantially when the voltage between the nodes crosses zero. The first and second oscillator switches are further configured to maintain opposite states.

The loss replenishment current source may comprise a current source inductor. The first and second oscillator switches may include MOSFETs, or IGBT devices.

The electronic high frequency induction heater driver may further comprise a first gate diode connected for allowing current flow from a gate of the first oscillator switch to the second node; and a second gate diode connected for allowing current flow from a gate of the second oscillator switch to the first node. In that case, the heater driver may further include a first gate resistor connecting the gate of the first oscillator switch to a supply voltage; and a second gate resistor connecting the gate of the second oscillator switch to the supply voltage.

The heater driver may further comprise a grounding switch for selectively connecting and disconnecting the first and second oscillator switches to ground. The heater driver may further include a heater driver transformer, the tank inductor comprising a primary coil of the heater driver transformer; a secondary coil of the heater driver transformer driving a high frequency induction heater.

Another embodiment of the invention is a heated fuel injector system. The system comprises a fuel injector including a fuel valve, an electromechanical actuator arranged for selectively opening and closing the fuel valve when DC electrical energy is applied to the electromechanical actuator, an induction heating coil for inducing heat in a metallic element of the fuel injector through a changing magnetic field when AC electrical energy is applied to the heating coil, and first and second injector terminals, the induction heating coil and the electromechanical actuator being electrically connected in parallel between the first and second injector terminals. The system further includes a DC circuit connected to the first and second terminals for selectively providing DC electrical energy to actuate the electromechanical actuator, the DC electrical energy being substantially blocked by a high-pass filter comprising the induction heating coil. The system also comprises an AC circuit connected to the first and second terminals for selectively providing AC electrical energy to activate the induction heating coil, the AC electrical energy being substantially blocked by a low-pass filter comprising the electromechanical actuator.

The electromechanical actuator may be a solenoid including a solenoid coil, in which case the system further includes a high-pass filter capacitor in series with the induction heating coil. The electromechanical actuator may be a piezoelectric actuator, in which case the system further includes a low-pass filter inductor in series with the piezoelectric actuator.

The heated fuel injector system may further comprise a heater driver transformer having a primary coil and a secondary coil, the secondary coil of the heater driver transformer comprising a portion of the AC circuit, the primary coil of heater driver transformer comprising a portion of a tank circuit, the AC circuit and the tank circuit being substantially impedance matched.

The system may further comprise a blocking inductor connected to the second injector terminal, the injector terminal being connected to ground through the blocking inductor, the blocking inductor comprising a low-pass filter to prevent the AC electrical energy from shunting to ground.

The heated fuel injector system may further include an injector driver switch for selectively connecting the DC electrical energy to the electromechanical actuator. The injector driver switch may selectively connect the electromechanical actuator to a supply voltage source. Alternatively, the injector driver switch may selectively connect the electromechanical actuator to ground.

Another embodiment of the invention is a method for driving an electronic high frequency induction heater using a tank circuit having first and second nodes and a tank inductor and a tank capacitor connected in parallel between the first and second nodes, the tank inductor and tank capacitor having values defining a natural frequency at which a voltage between the nodes oscillates between negative and positive values, the tank inductor being a primary coil in a heater driver transformer. In that method, a loss replenishment voltage is applied to a center tap of the tank inductor. Substantially when the voltage between the nodes crosses zero in a first direction, a gate of a first oscillator switch is charged, the first oscillator switch having an open state isolating the first node from ground and a closed state grounding the first node; and a gate of a second oscillator switch is discharged, the second oscillator switch having an open state isolating the second node from ground and a closed state grounding the second node.

Substantially when the voltage between the nodes crosses zero in a second direction, the gate of the first oscillator switch is discharged; and the gate of the second oscillator switch is charged. The electronic high frequency induction heater is driven with a secondary coil of the heater driver transformer.

The step of applying a loss replenishment voltage to a center tap of the tank inductor may comprise applying the loss replenishment voltage through a current source inductor. The first and second oscillator switches may be MOSFETs, or may be IGBT devices.

The method may further comprising the steps of, in a first gate diode, preventing current flow from the second node to the gate of the first oscillator switch, and, in a second gate diode, preventing current flow from the first node to the gate of the second oscillator switch. In that case, the method may further include the steps of providing a first gate resistor connecting the gate of the first oscillator switch and the first gate diode to a gate supply voltage; and providing a second gate resistor connecting the gate of the second oscillator switch and the second gate diode to the gate supply voltage.

The method may further include the steps of selectively connecting and disconnecting the first and second switches to ground through a grounding switch.

DESCRIPTION OF THE INVENTION

Ideally, energy should be replenished to the tank circuit when either the voltage or the current in the switching device is zero. It is known that the electromagnetic noise is lower during zero-voltage or zero-current switching, and is lowest during zero-voltage switching. It is also known that the switching device dissipates the least power under zero switching. That ideal switching point occurs twice per cycle when the sine wave crosses zero and reverses polarity; i.e., when the sine wave crosses zero in a first direction from positive to negative, and when the sine wave crosses zero in a second direction from negative to positive.

The apparatus and method of the present invention eliminate hard-switching and its negative consequences, and replace it with zero-voltage switching. In addition, the invention significantly reduces the current pulses from the voltage supply to a level of constant current, further reducing system noise. The preferred embodiment of the invention also isolates the high frequency energy to a dedicated AC path such that operation of another component, such as a fuel injector solenoid, is not affected by sharing an electrical ground return path. The electrical ground return path may be shared with the injector solenoid, necessitating the turn-off of the heater driver during injector turn-off. In a preferred embodiment, additional wires to the fuel injector are not necessary to drive the heater. Instead, the inventive system uses a signal separator inside the fuel injector.

The integrated functions of the electronic high frequency induction heater driver of the invention will be explained with reference to FIG. 1, which is a simplified representation 100 of the inventive circuit with many of the basic components eliminated for clarity. Specific or general values, ratings, additions, inclusion or exclusion of components are not intended to affect the scope of the invention.

L2, C3 and L3 reside inside the fuel injector. L3 is the induction heating coil that provides the necessary ampere-turns for induction heating the suitable fuel injector component. C3 is a high-pass filter capacitor. L3 with C3 are connected in series between first and second injector terminals 120, 121 and form a high-pass filter and a portion of the AC loop. L2 is the solenoid coil that opens the injection valve when energized by Q2. L2 is connected between the injector terminals 120, 121 in parallel with the L3/C3 series, and presents a low-pass filter.

Figure 1:
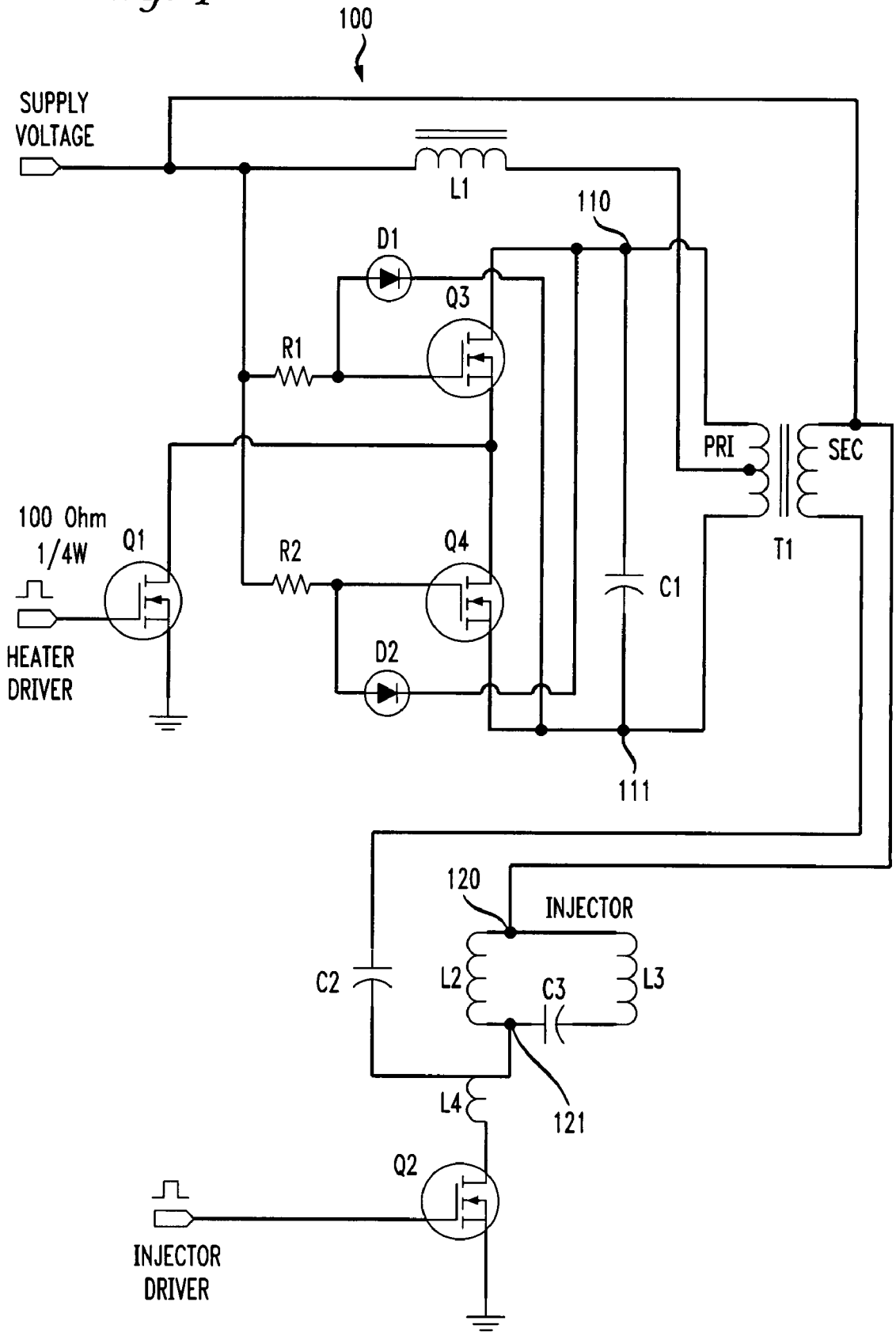
FIG. 1 is a simplified electrical schematic diagram showing an electronic high frequency induction heater driver in accordance with the invention.

As shown in FIG. 1, switching for the DC injector driver circuit may be a "low side" injector driver arrangement, wherein DC electrical energy from the supply voltage is applied to the injector terminal 120, and the connection from the terminal 121 to ground is switched by MOSFET Q2. In an alternative arrangement, the injector driver circuit is switched in a "high side" arrangement (not shown), wherein a connection from the supply voltage to the injector terminal 120 is switched.

The combined low-pass and high-pass filter functions of L2, C3 and L3 allow for two-wire operation of the heated injector so that both the DC pulse portion operating the injection valve and the AC current of the heater reside simultaneously on the shared wire pair. L4 forms another low pass filter and serves as a blocking inductor to prevent the high frequency alternating current from shunting away from the injector through ground and the voltage supply, which otherwise represent a low impedance AC path. Injector driver switch Q2 is a MOSFET switch that connects the voltage supply to ground through L2 and, when turned on, energizes the injector valve solenoid L2.

The supply voltage to L2, then to L4 and Q2 to ground, comprise the DC circuit for the injection valve.

R1, R2, D1, D2, Q3, Q4, L1, C1 and the primary side of a heater driver transformer T1 comprise the constant current zero-switching oscillator circuit. Q1 is a MOSFET switch that connects the zero-switching circuit to ground and, when turned on, enables the high frequency induction heating function of the invention.

C1 and the primary coil or winding of T1 are the tank capacitor and tank inductor, respectively, of a resonant tank circuit having nodes 110, 111 between which C1 and T1 are arranged in parallel. The resonant frequency of the tank circuit is $fr=1/(2\pi\sqrt{LC})$, where L is the primary coil inductance and C is the capacitance of C1. The peak voltage in the tank circuit is set by $V_{out}=\pi*V_{in}$ where $V_{in}$ is the supply voltage. The current level in the tank circuit is determined from the energy balance of $$\frac{1}{2}LI^2 = \frac{1}{2}CV^2.$$

The secondary coil of T1, and C2, C3, L3 comprise the AC circuit loop which is impedance-matched to the tank circuit such that the high frequency alternating current is maximized through L3.

The zero-switching oscillator circuit is derived from a Royer-type oscillator topology, but with the successful elimination of the feedback winding on T1 typical of a Royer oscillator and the implementation with MOSFET switches rather than conventional NPN or PNP transistors with their associated base-to-emitter current draw. The MOSFET is a device that requires a certain amount of Coulomb charge into the gate, which is drain-source current-dependent. Once the charge is satisfied, it fully enhances the device into an 'on' state. First and second gate resistors R1, R2 supply the gate charging current to first and second oscillator switches Q3, Q4, respectively, and limit the current flowing into first and second gate diodes D1, D2, respectively.

The loading caused by the resistive and hysteretic loss of the heated component reflects back as a loss in the resonant tank circuit. That loss is replenished by current flowing from a current source inductor L1 to the center-tap of the primary of T1. Depending on the portion of the T1 primary to which the current flows, the current will flow either through Q3 or Q4 and then to a grounding switch Q1 to ground. L1 supplies current to the tank circuit from the energy stored in its magnetic field. That energy is replenished from the supply voltage as a constant current flowing into L1. The current from L1 to the tank circuit is in pulses at a rate of twice the tank frequency.

If current is flowing through Q3, as determined by the polarity of the sine wave half-cycle at that time, and the device is in enhancement from the charge supplied by R1, then the conduction to ground from Q3 drain-to-source pulls charge out of the gate of Q4 through D2. Q4 is also now not conducting and does not pull the gate charge out of Q3 to ground through D1. R2 does draw current from the supply voltage at the same time, but the IR drop across R2 cannot charge the gate of Q4 with the gate shunted to ground by conduction through Q3.

When the sine wave crosses zero, then Q3 becomes reverse biased and conducts through the internal intrinsic diode to reverse-bias D2. D2 stops conducting current away from the Q4 gate and R2 now can charge the gate of Q4 and turn it on to begin conducting current for the continuing sine half-cycle. Q4 now also pulls the gate charge out of Q3 to ground through D1 and holds Q3 in a non-conducting state which continues to allow R2 to fully enhance Q4.

That process repeats as the sine wave alternates polarity, crossing zero in a first direction from negative to positive, and then in a second direction from positive to negative. Current continues to be replenished in the tank circuit from L1. An IGBT device can replace the MOSFET in this embodiment if the intrinsic diode of the MOSFET is represented by the addition of an external diode across the drain and source of the IGBT. One skilled in the art will recognize that other insulated gate or indirectly enhanced semiconductor switches may be substituted without departing from the invention.

Figure 2:
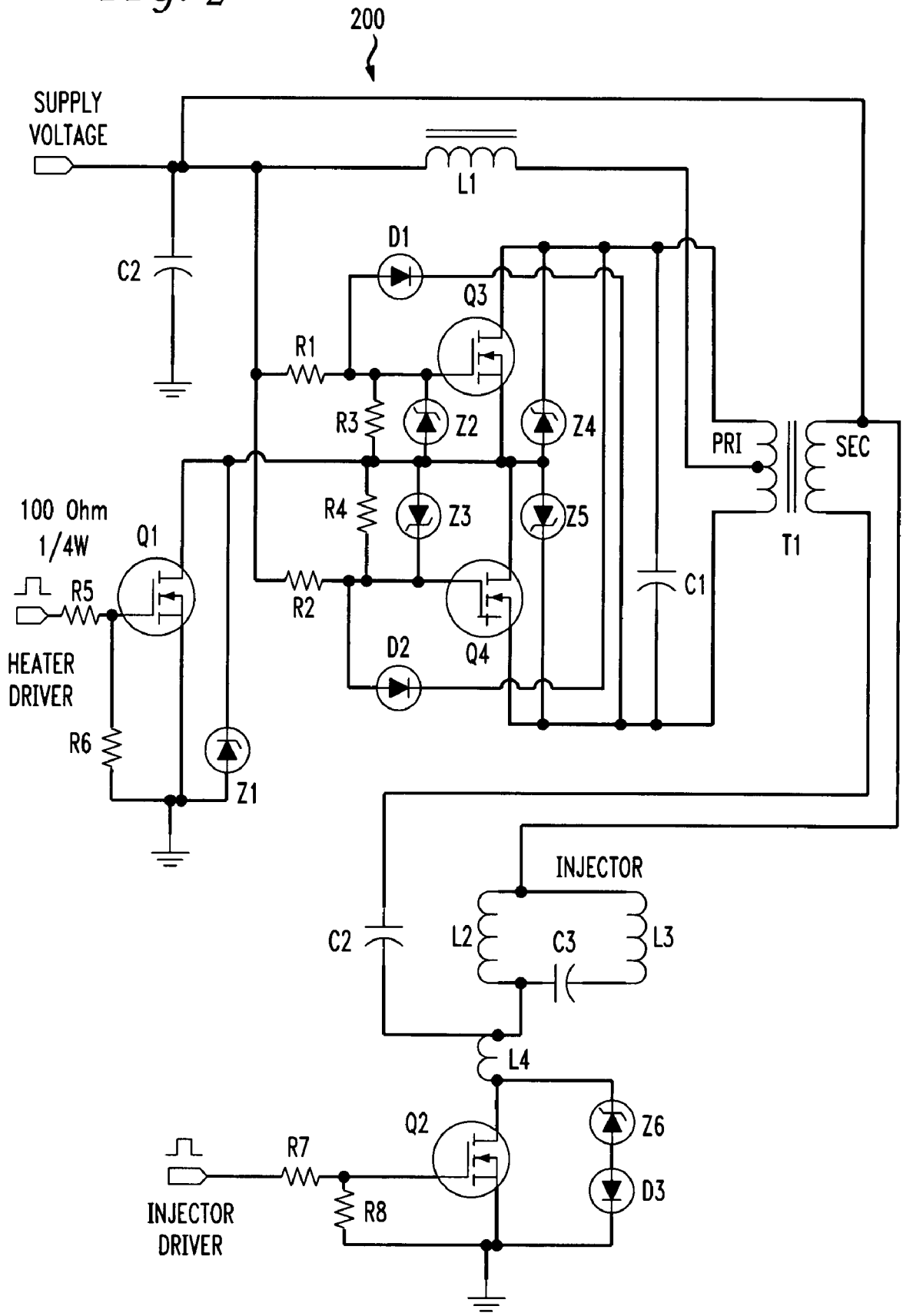
FIG. 2 is another electrical schematic diagram showing an electronic high frequency induction heater driver in accordance with the invention.

FIG. 2 depicts a more complete circuit 200 with several basic functions satisfied for the reliable and characteristic operation of the induction heater driver with the integrated injection valve driver. Elements referenced in previous drawings are identified with like references in FIG. 2.

The resistor pair of R5 and R6 and the resistor pair R7 and R8 each form a voltage divider to ensure the gates of Q1 and Q2, respectively, are pulled to ground and held in an 'off' state when there is no signal to keep the gates 'on.' When there is a signal, the impedances of R6 and R8 to ground are each high enough to allow enough current in an appropriately short period of time to flow into the gates to fully enhance Q1 and Q2, respectively.

Z1 is a zener diode protection device for the protection of Q1 from voltage spikes. Those spikes may be caused by the collapse of the magnetic field in L1 and T1 or transformer-coupled inductive spikes from L2 or L3, or over-voltage of the tank circuit resonance. Also, in the case where the internal avalanche dissipation is exceeded due to high speed switching of Q1 on and off, Z1 shares the dissipation burden to protect Q1. Z4 and Z5 protect Q3 and Q4 from transformer-coupled inductive spikes from L2 or L3.

Z2 and Z3 are zener diodes used as voltage regulators, with R3 and R4 in parallel, to limit the charge voltage at the gate of Q3 and Q4 such that the charge voltage is appropriate to fully enhance the MOSFET for the maximum drain-source current expected. Z2 and Z3 also fix the gate voltage so that charge times are identical and protect the gates to below their maximum voltage limit in the case of noise or abnormally high supply voltage.

Z6 and D3 serve the purposes of protecting Q2 from inductive voltage spikes from L2 and L3 as well as transformer-coupled over-voltages from the tank circuit. Z6 also serves to set the decay rate of the field of L2 during injection valve turn-off, and that helps make the valve closing time more consistent and appropriate for the calibration of the injection valve. R7, R8, Q2, Z6 and D3 together comprise a basic injection valve driver known as a 'saturated-switch' driver. One skilled in the art will recognize that a 'peak-and-hold' driver or other type of electronics may be substituted without affecting the basic function of the invention.

Figure 3:
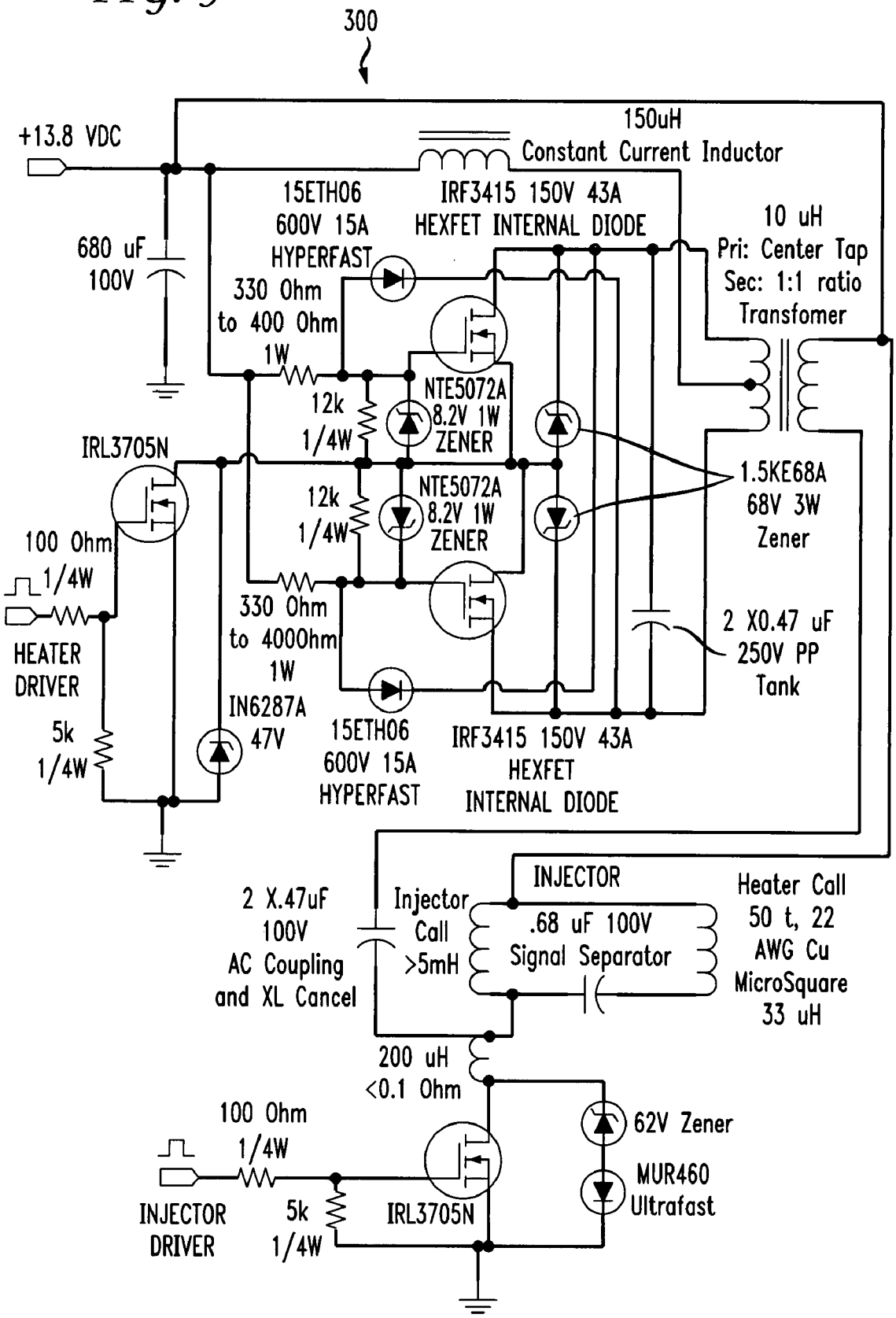
FIG. 3 is an electrical schematic diagram showing an electronic high frequency induction heater driver with exemplary component values in accordance with the invention.

FIG. 3 depicts an embodiment 300 of the heater driver and injector driver circuit of FIG. 2. Specific component values and specifications are shown in FIG. 3 to illustrate a working prototype. Those values and specifications are merely exemplary and are not intended to limit the scope of the invention.

Figure 4A:
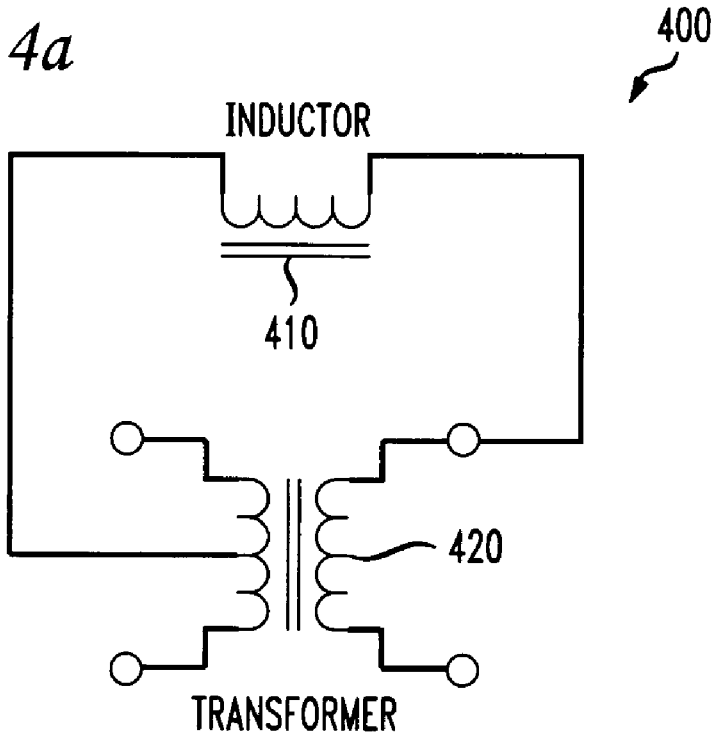
FIG. 4*a* is an electrical schematic diagram of a transformer in accordance with an alternate embodiment of the invention.

The heater driver transformer T1 and the current source inductor L1 may be combined into a hybrid component 400, shown in FIG. 4*a*. In such a hybrid component, the current source inductor 410 directly taps the high side of the secondary winding 420 of the heater driver transformer for the constant input current.

Figure 4B:
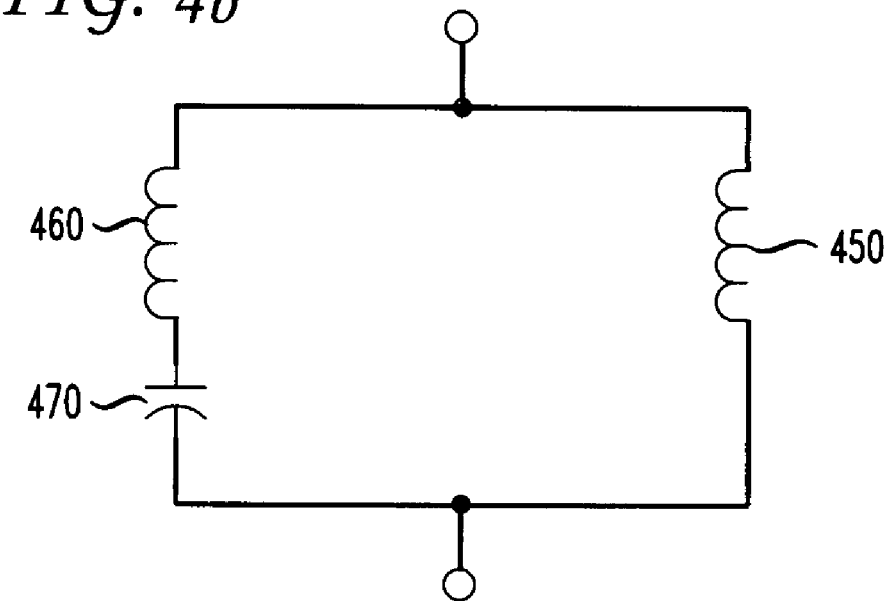
FIG. 4*b* is an electrical schematic diagram of a heated fuel injector in accordance with an alternate embodiment of the invention.

The heater driver/injector driver arrangement of the invention may include electromechanical valve actuators other than solenoid actuators. For example, as illustrated in FIG. 4*b*, a piezoelectric actuator, shown as capacitor 470, may be substituted for the solenoid L2 of FIG. 1. In that case, the piezoelectric actuator 470, together with an inductor 460 in series with the piezoelectric actuator, act as a low-pass filter, while the inductive heater coil 450 acts as a high-pass filter. Other electromechanical valve actuators may be used without departing from the scope of the invention. Further, one skilled in the art will recognize other arrangements for separating the high frequency heater driver signal from the DC injector driver signal.

Figure 5:
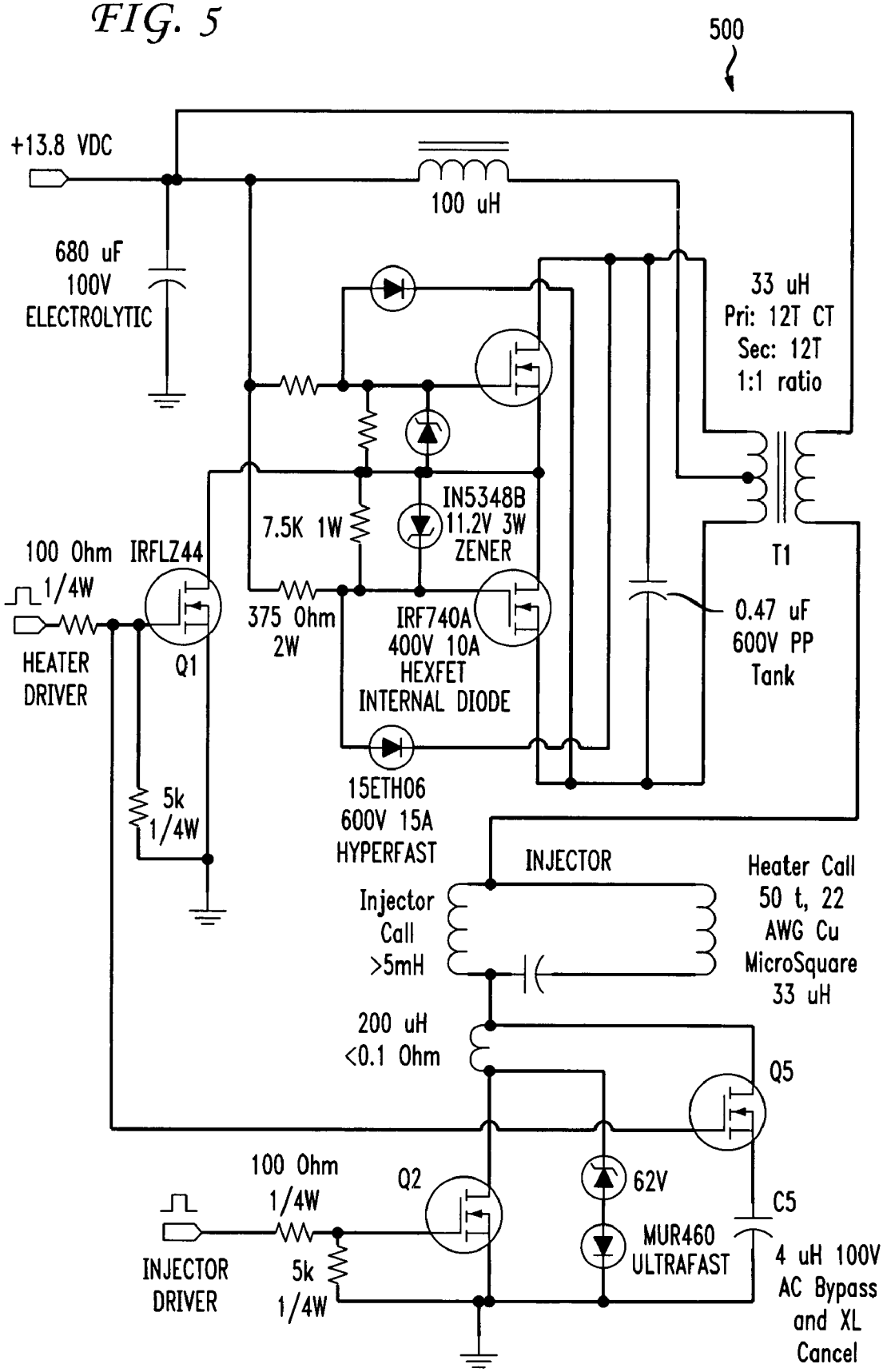
FIG. 5 is an electrical schematic diagram showing an electronic high frequency induction heater driver in accordance with an alternative embodiment of the invention.

FIG. 5 depicts an alternative embodiment 500 which uses the combined low impedance point, of ground and supply voltage, as the return path for the high frequency alternating current back to T1. That embodiment includes an additional MOSFET switch Q5, enabled when Q1 is enabled, and a high pass filter in the form of an AC bypass capacitor C5 to shunt the high frequency current to ground when Q2 is not turned 'on.' The primary disadvantage to that alternative embodiment is that the induction heater must be turned off in a duration window including and prior to the injection driver, Q2, turn-off, otherwise the injection valve closing will be different with the AC bypass capacitor C5 shunting across Q2. Specific component values are shown in FIG. 5 and reflect a working prototype of this embodiment.

Figure 6:
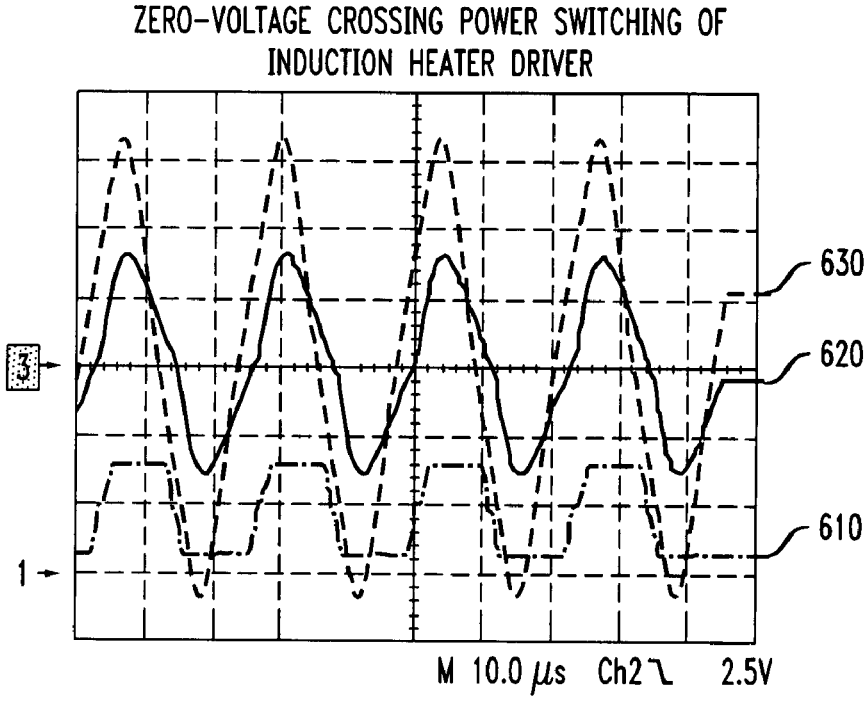
FIG. 6 is a plot illustrating zero crossing power switching of an induction heater driver in accordance with the invention.

FIG. 6 depicts a gate voltage 610 of Q3 at 5 volts per division, the drain-to-drain voltage 620 across Q3 and Q4 at 25 volts per division, which is the tank voltage, and the heating current 630 going to the injector at the top of L2/L3 at 2 amperes per division. The plot of FIG. 6 demonstrates the zero-voltage switching of the heater driver circuit. The gate of Q3 is turned 'on' (voltage 610 goes up) when the sine wave 620 crosses zero and goes positive and the gate of Q3 turns 'off' (voltage 610 goes down) when the sine wave 620 again crosses zero and goes negative. The resulting sinusoidal heating current 630 to the induction heating coil is thereby generated.

Figure 7:
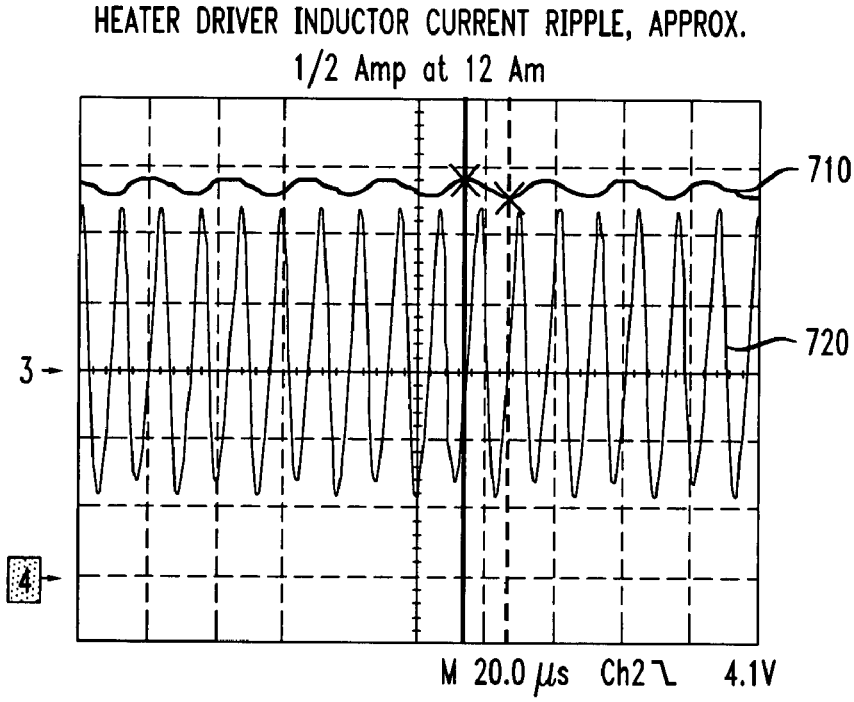
FIG. 7 is a plot illustrating heater driver inductor current ripple of a system in accordance with the invention.

FIG. 7 depicts the supply current 710 to inductor L1 at 2 amperes per division and the voltage 720 across the current source inductor L1 at 10 volts per division. This figure demonstrates the substantially constant current draw of the heater driver circuit, showing less than 5% current ripple. Voltage pulsation 720 across the current source inductor is at twice the tank resonant frequency.

Figure 8:
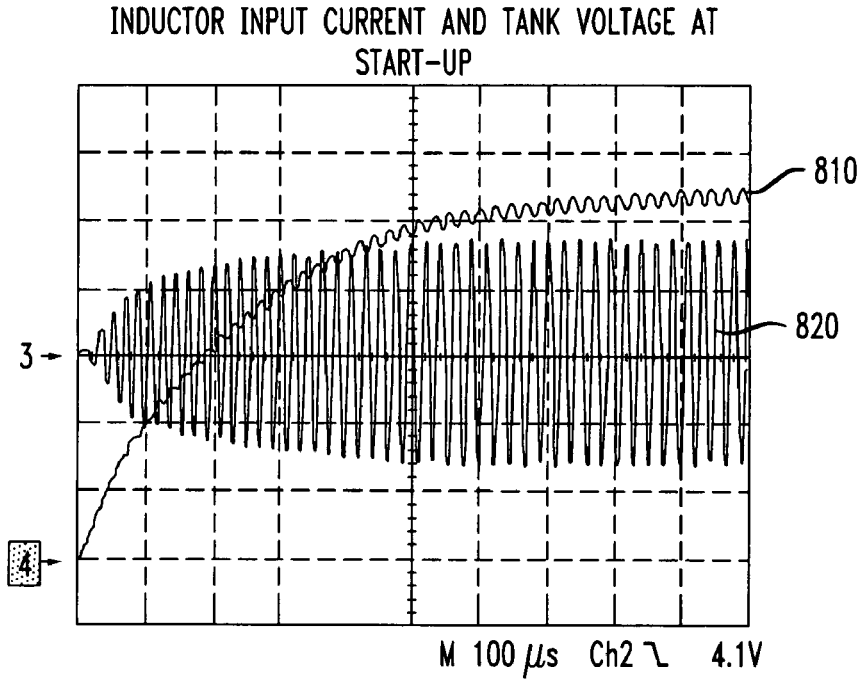
FIG. 8 is a plot showing inductor input current and tank voltage at start-up of a system in accordance with the invention.

FIG. 8 depicts the supply current 810 to current source inductor L1 at 2 amperes per division and the drain-to-drain voltage 820 across Q3 and Q4 at 25 volts per division, which is the tank voltage. The parameters were measured during start-up of the heater driver. The figure demonstrates the self-oscillating start-up of the heater driver when Q1 is turned 'on.'

Figure 9:
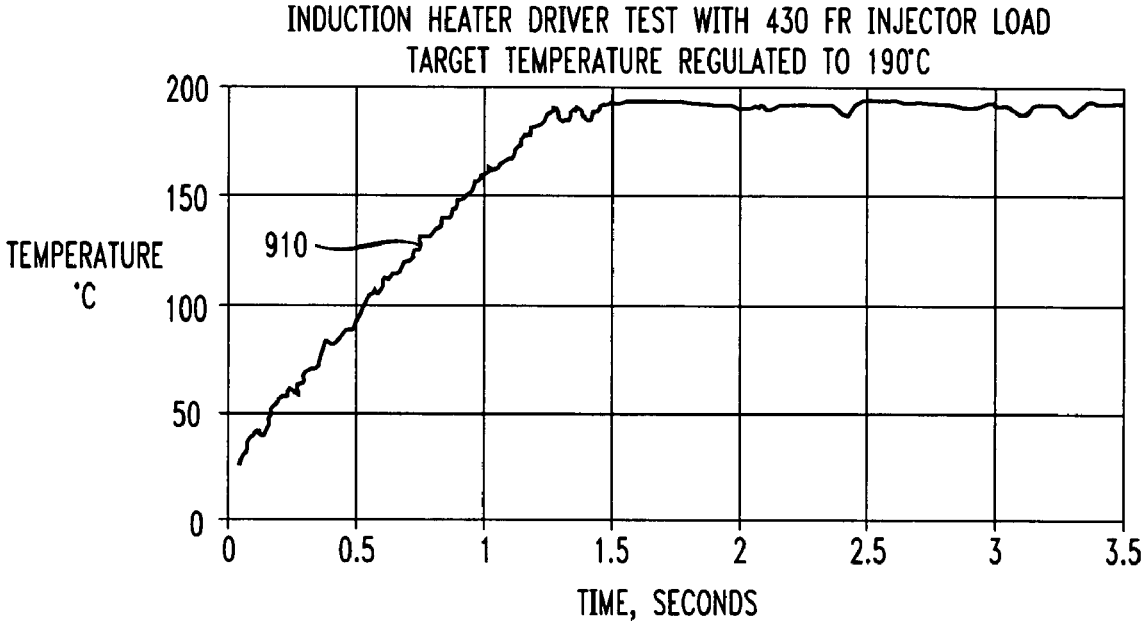
FIG. 9 is a plot showing temperature of an injector component versus time, in a test of a system in accordance with the invention.

FIG. 9 shows the temperature 910, in ° C., of an appropriate injector component heated to a target temperature of 190° C. and regulated there by turning Q1 'on' and 'off,' under software control. The measurements were made under conditions including voltage and current levels similar to those of FIGS. 6, 7 and 8. Power from the supply voltage during the heating period is 160 watts in this example. The heating time from ambient, 25° C., to 130° C. is under 0.7 seconds, demonstrating the speed of the new method of heating the fuel with a time-varying magnetic field.

Figure 10:
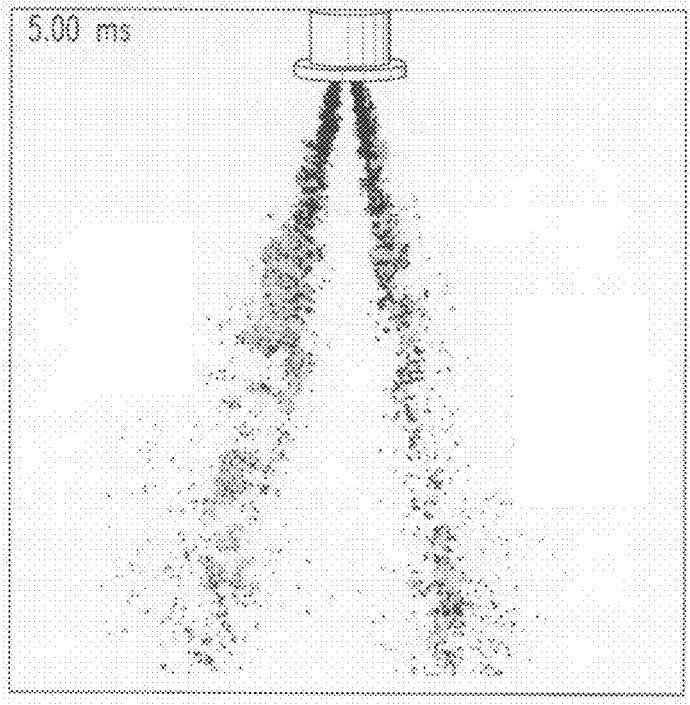
FIG. 10 is a photographic image of a fuel injector spray with the inductive heater of the invention disabled.
Figure 11:
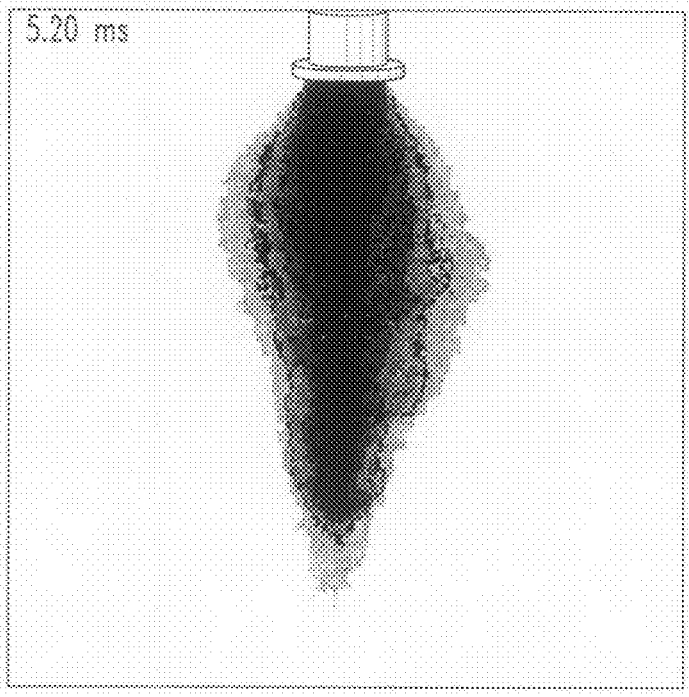
FIG. 11 is a photographic image of a fuel injector spray with the inductive heater of the invention enabled.

FIG. 10 depicts the fuel spray of ethanol fuel grade E-100 without the heater driver enabled. A 2-hole split-stream orifice determines the spray shape and atomization. FIG. 11 depicts the fuel spray of ethanol fuel grade E-100 with the heater driver enabled and regulated to 110° C. The orifice no longer determines the spray shape or atomization since the fuel is nearly vapor as it flash-boils upon leaving the fuel injector.

The foregoing detailed description is to be understood as being in every respect illustrative and exemplary, but not restrictive, and the scope of the invention disclosed herein is not to be determined from the description of the invention, but rather from the claims as interpreted according to the full breadth permitted by the patent laws. For example, while the electronic high frequency induction heater driver of the invention is described herein driving an internal heater in an internal combustion engine fuel injector, the driver may be used to drive other induction heaters in other applications. It is to be understood that the embodiments shown and described herein are only illustrative of the principles of the present invention and that various modifications may be implemented by those skilled in the art without departing from the scope and spirit of the invention.

What is claimed is:

1. A heated fuel injector system, comprising:

a fuel injector including:

a fuel valve;

an electromechanical actuator arranged for selectively opening and closing the fuel valve when DC electrical energy is applied to the electromechanical actuator;

an induction heating coil for inducing heat in a metallic element of the fuel injector though a changing magnetic field when AC electrical energy is applied to the heating coil; and first and second injector terminals, the induction heating coil and the electromechanical actuator being electrically connected in parallel between the first and second injector terminals;

a DC circuit connected to the first and second terminals for selectively providing DC electrical energy to actuate the electromechanical actuator, the DC electrical energy being substantially blocked by a high-pass filter comprising the induction heating coil; and an AC circuit connected to the first and second terminals for selectively providing AC electrical energy to activate the induction heating coil, the AC electrical energy being substantially blocked by a low-pass filter comprising the electromechanical actuator.

2. The heated fuel injector system of claim 1, wherein the electromechanical actuator is a solenoid including a solenoid coil, the system further comprising:

a high-pass filter capacitor in series with the induction heating coil.

3. The heated fuel injector system of claim 1, wherein the electromechanical actuator is a piezoelectric actuator, the system further comprising:

a low-pass filter inductor in series with the piezoelectric actuator.

4. The heated fuel injector system of claim 1, further comprising:

a heater driver transformer having a primary coil and a secondary coil;

the secondary coil of the heater driver transformer comprising a portion of the AC circuit;

the primary coil of heater driver transformer comprising a portion of a tank circuit, the AC circuit and the tank circuit being substantially impedance matched.

5. The heated fuel injector system of claim 1, further comprising:

a blocking inductor connected to the second injector terminal, the injector terminal being connected to ground through the blocking inductor, the blocking inductor comprising a low-pass filter to prevent the AC electrical energy from shunting to ground.

6. The heated fuel injector system of claim 1, further comprising: an injector driver switch for selectively connecting the DC electrical energy to the electromechanical actuator.

7. The heated fuel injector system of claim 6, wherein said injector driver switch selectively connects the electromechanical actuator to a supply voltage source.

8. The heated fuel injector system of claim 6, wherein said injector driver switch selectively connects the electromechanical actuator to ground.

* * * * *